United States Patent [19]

Marchetti

[11] Patent Number: 4,572,760

[45] Date of Patent: Feb. 25, 1986

[54] TAPING MACHINE WITH EASILY REMOVABLE AND REATTACHABLE VERTICAL COMPONENTS AND WITH DOUBLING POSSIBILITY

[76] Inventor: Augusto Marchetti, Piazza Sicilia, 7, 20146 Milano, Italy

[21] Appl. No.: 582,234

[22] Filed: Feb. 21, 1984

[30] Foreign Application Priority Data

Feb. 24, 1983 [IT] Italy ..... 20913/83[U]

[51] Int. Cl.[4] ..... B65B 61/00

[52] U.S. Cl. ..... 156/468; 53/137; 198/861.1

[58] Field of Search ..... 156/468, 475; 53/137, 53/590; 198/627, 726, 862; 193/35 R, 35 C, 35 TE

[56] References Cited

U.S. PATENT DOCUMENTS

| | | | |
|---|---|---|---|
| 3,052,072 | 9/1962 | Keely | 53/137 X |
| 3,097,461 | 7/1963 | Arril | 53/137 |
| 4,161,138 | 7/1979 | Marchetti | 53/137 X |

*Primary Examiner*—David Simmons

*Attorney, Agent, or Firm*—Cushman, Darby & Cushman

[57] ABSTRACT

A carton support base is formed by a rectangular frame, a succession of idle transversal rollers surrounded by said frame, and vertical legs passing through the frame and clamped thereto in adjustable position. From the sides of the frame there extend upwards a pair of vertical columns, which are releasably fixed to support brackets of limited vertical extension. The legs and the column can thus be removed to limit the overall size of the taping machine during transport. In addition, two taping machines can be superimposed to one another in overturned condition to form a "doubled" machine, which is able to apply adhesive sealing tapes to very high cartons.

6 Claims, 12 Drawing Figures

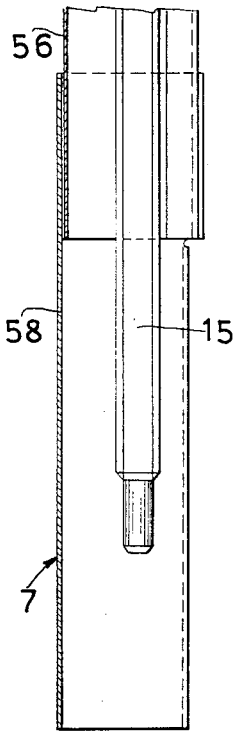
Fig. 8
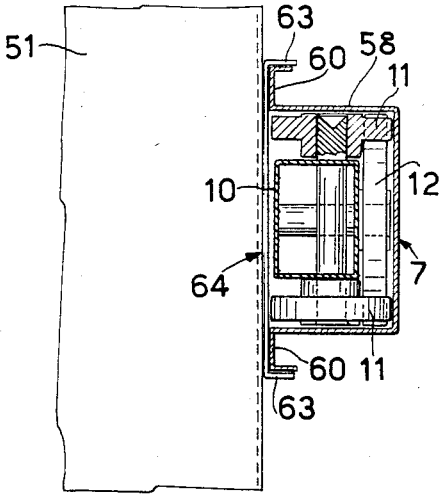
Fig. 10
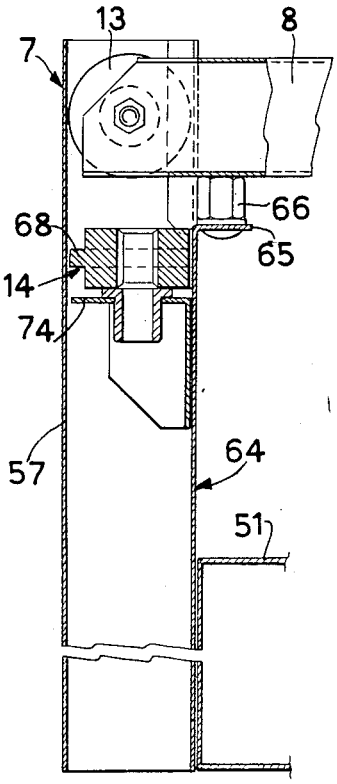
Fig. 9
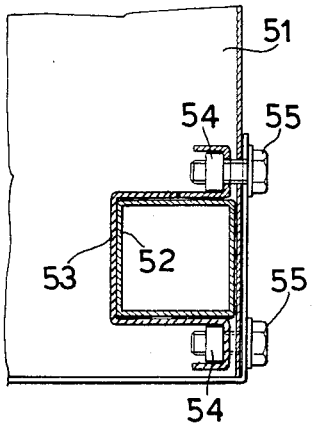

TAPING MACHINE WITH EASILY REMOVABLE AND REATTACHABLE VERTICAL COMPONENTS AND WITH DOUBLING POSSIBILITY

The present invention relates to a taping machine, which has easily removable and reattachable vertical components and provides for the possibility of doubling the same machine for some uses.

A taping machine, intended as a machine able to apply sealing adhesive tapes along the bottom and the top of parallelogram cartons, comprises in known way a support base on which the cartons are made to advance by suitable conveying units for their passage through a sealing area defined by a lower taping group and by an upper taping group.

The support base is substantially formed by a rectangular frame, which supports a plurality of idle transversal rollers defining the carton support plane, the two conveying units and the lower taping group. The frame is supported at a certain distance from ground by four legs which extend downwards from the corners of the frame.

From the two longer sides of the same frame, in intermediate position between the two ends, there extend upwards two columns, to which a crossbar suitable for the support of the upper taping groups is supported and guided at adjustable height.

The legs and the columns therefore constitute vertically extending structural components, which are obviously a cause of bulk and consequent problems during the transportation.

The presently used legs are either of fixed length, so that they do not allow to adjust the height of the carton support base according to the different needs, or of adjustable length, but in such case they are more or less complex from the constructive and functional point of view.

The object of the present invention is therefore to produce a taping machine, whose vertical components, comprising the legs and the columns, are easily removable (and then reattachable), so as to allow a suitable bulk reduction during the transport.

Another object is to realize a taping machine, in which the legs and extremely simple locking systems allow the easy and quick height adjustment of the carton support base.

According to the invention such objects have been reached by means of a taping machine, comprising a carton support base, a pair of carton conveying units, a lower taping group and an upper taping group, said support base comprising a frame provided with vertical legs which supports a plurality of idle transversal rollers, said conveying units and said lower taping group and from which there extend upwards two vertical columns suitable for the support and the guide of a support crossbar for the upper taping group, characterized in that said legs are coupled to the frame in passing-through way and releasably clamped thereto in adjustable position and said columns are releasably fixed to support brackets of limited vertical extension, in their turn fixed to the frame.

Preferably, the columns are formed by at least two pieces connected to one another, the lower one of which is releasably fixed to said support bracket and the upper one of which is releasably fixed to the lower one to extend the height thereof up to a desired level in function of the height of the cartons to be sealed.

It is evident that in such a construction the legs, originally adjusted in the most suitable position to obtain the desired height for the carton support base, can be completely separated by the frame, thus stopping being cause of bulk. The columns also can be removed, leaving attached to the frame only short support brackets, which substantially do not constitute vertical bulk and, if desired, can be releasably fixed to the frame.

The bulk of the machine during the transport is thus reduced, with the obvious resulting advantages.

On the other hand, the sliding connection of the legs with the frame allows adjustment to the most suitable height for the different needs, having at the same time the advantages of a considerable structural simplicity and adjustment ease.

Finally, through the sliding connection of the legs and the complete removability of the columns, it is possible to provide for the use of the machine in doubled condition, that is two frames without columns (but with conveying units and lower taping groups) are disposed on one another with the upper one overturned, by using common legs of great length for the support of both frames. In such way, it is possible to execute the sealing of cartons of great height, otherwise not acceptable or at best not correctly handled by a single standard machine. This allows to considerably enlarge the field of use of the machine.

The features of the present invention will be made more evident by the following detailed description of an embodiment illustrated by way of example in the enclosed drawings, in which:

FIG. 8 shows an enlarged detail of the other column, in section along line VIII—VIII of FIG. 2;

FIG. 9 shows an enlarged detail of the legs of the above mentioned machine, in section along line IX—IX of FIG. 2;

FIG. 10 shows how the two columns of the above mentioned machine can be separated in two pieces for their disassembly in case of transport;

Figure 1:
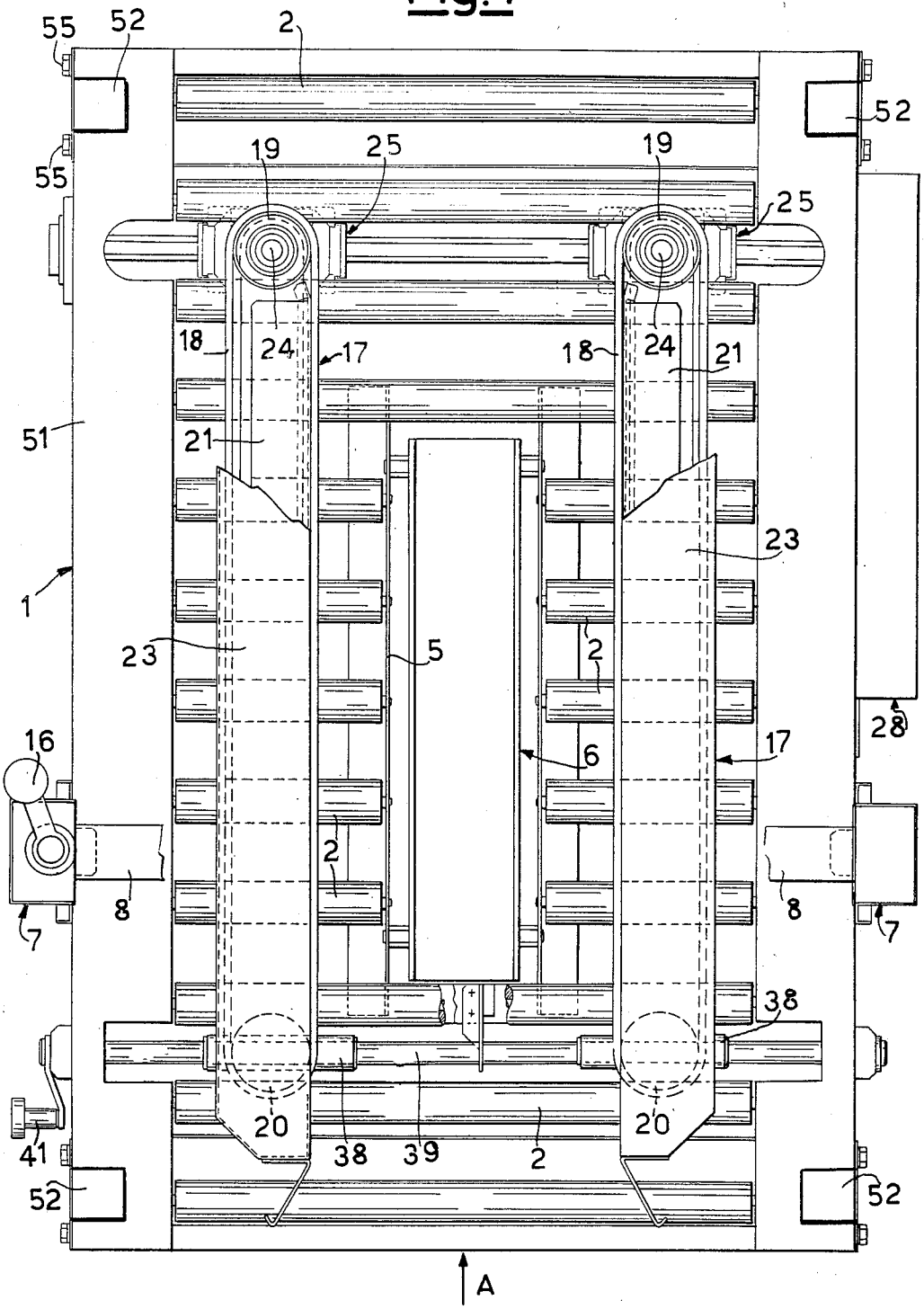
FIG. 1 shows a taping machine according to the invention, with the upper taping group removed for clarity of drawing.

In the drawings there is illustrated a taping machine, which substantially comprises a base 1, two conveying belt unit 17, a lower taping group 6 and an upper taping group 9.

Figure 2:
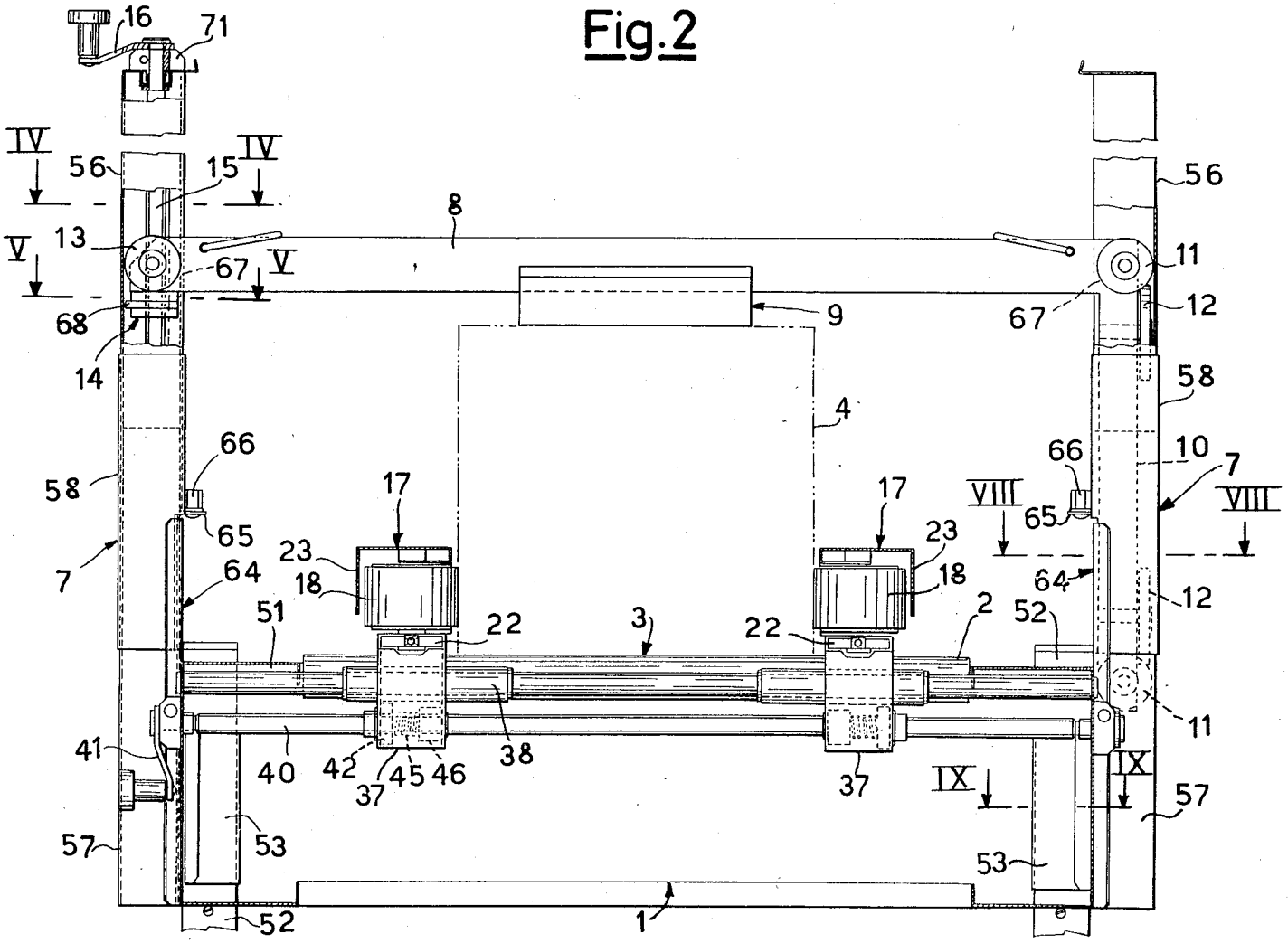
FIG. 2 shows said taping machine in elevation, seen according to arrow A of FIG. 1.
Figure 3:
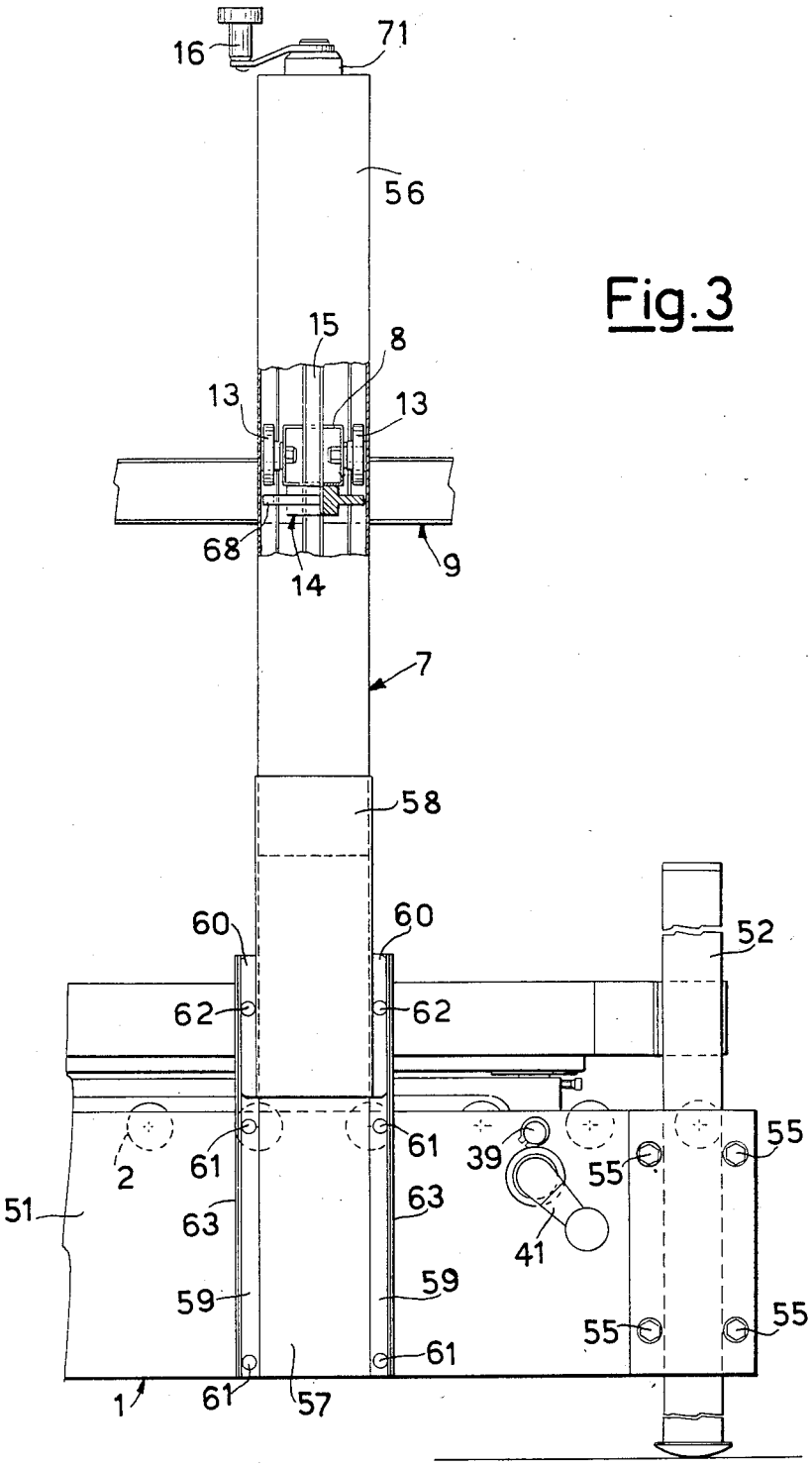
FIG. 3 shows a side of said taping machine, limited to the part destined for the introduction of the cartons and including the two vertical columns.
Figure 4:
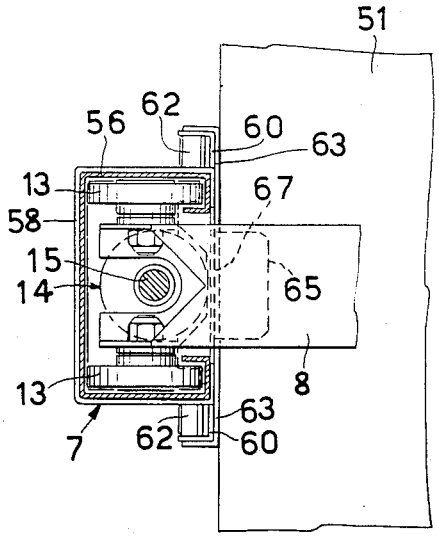
FIG. 4 shows the enlarged detail of one of said columns in section along line IV—IV of FIG. 2.
Figure 5:
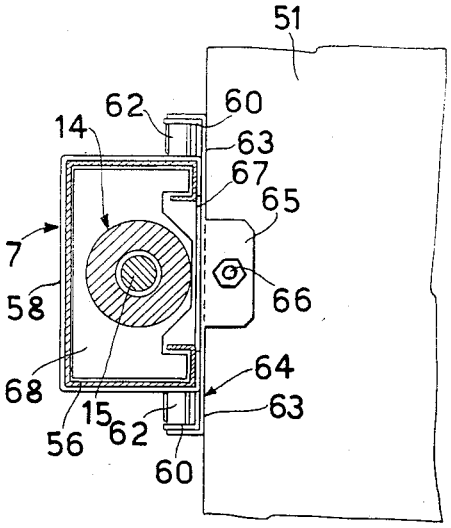
FIG. 5 shows the same detail in section along line V—V of FIG. 2.

As it can be seen from FIGS. 1, 2 and 3, the base 1 comprises a rectangular frame 51, which surrounds and supports a plurality of idle transversal rollers 2, parallel to each other, by which a support plane 3 is defined for the cartons to be sealed. One of these cartons is schematically illustrated and indicated on the whole with the reference number 4 in FIG. 2.

At the center of the above mentioned succession of rollers there is defined a rectangular space 5 (FIG. 1) in which there is inserted and releasably fixed the lower taping group 6 (not shown in details for simplicity of drawing), which has the function to apply an adhesive sealing tape along the slot usually provided along the carton bottom.

The support of the frame 51, at suitably adjustable height according to the different needs, comprises four vertical legs 52, of box-like shape with square section (FIGS. 1, 2, 3 and 9), which completely pass through the frame 51 (FIGS. 2 and 3) and are releasably clamped by C-shaped brackets 53 releasably fixed to the frame 51 by means of bolts 55 and nuts 54 (FIGS. 1, 3 and 9).

From the two sides of the base 1 there extend upwards two columns 7, each of which is formed by three box-like pieces 56, 57 and 58 (FIGS. 2 and 3), of which the upper piece 56 is abuts the lower piece 57 with the intermediate piece 58 surrounding the connection zone. For the fixing of the column 7 to the frame 51, both the lower piece 57 and the intermediate piece 58 are provided with outwardly turned flanges 59, 60, which are connected and fixed by means of screws or bolts 61, 62 to corresponding flanges 63 of a support bracket 64 made integral with the frame 51 and provided with an upper flap 65 with a nut 66 (FIGS. 2–5). The upper piece 56 is in its turn inserted in the intermediate piece 58 and abuted against the lower piece 57.

Figure 6:
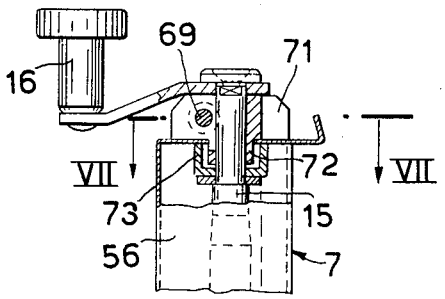
FIG. 6 shows another enlarged detail of the same column, partially sectioned in a vertical plane.
Figure 7:
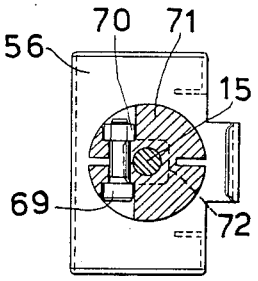
FIG. 7 shows said other detail in section along line VII—VII of FIG. 6.

The two columns 7 are for the support and the vertical guide of a horizontal crossbar 8 for the support of the upper taping group 9 (FIGS. 2 and 3), which has the function to apply a sealing adhesive tape along the slot usually provided along the carton top. As illustrated in FIG. 2, the two ends of the crossbar 8 go inside the corresponding columns 7 through elongated vertical slits 67 of the upper piece 56 of the same columns (as well as of the intermediate piece 58). From one of these (the right one looking at FIG. 2) there extends downwards a vertical box-like arm 10 slidingly coupled to the column 7 by means of guide wheels 11 and 12 with perpendicular axes (FIGS. 2 and 8). The other end of the crossbar 8 is in its turn provided with a pair of guide wheels 13 (FIGS. 2–4) and lays on an internally threaded underneath bush 14, which is slidingly housed inside the upper piece 56 of the column 7 under the guide of an opportunely shaped intermediate portion 68 (FIGS. 2, 3 and 5) and at the same time in screw engagement with a threaded shaft 15, which vertically extends inside the column 7 and is provided with a drive crank 16. Through the rotation of this latter it is possible to adjust the position of the crossbar 8, and consequently of the upper taping group 9, according to the height of the cartons to be sealed. As shown in FIGS. 6 and 7, on the upper end of the threaded shaft 15 there is also normally blocked by means of a screw 69 and a nut 70 a bushing 71, which shows a square lower appendage 72 received in a corresponding square seat 73 obtained in the column top. The engagement between the two square shapes of the appendage 72 and of the seat 73 prevents the unwanted rotation of the shaft 15, and consequently the unwanted adjustment of the height of the upper taping group 9, unless a suitable and wanted intervention on the blocking screw 69 allows simultaneously the release of the connection between the bushing 71 and the shaft 15, leaving this latter free to rotate under the control of the crank 16.

For the advancement of the cartons on the support base 3 (in the direction of arrow (A) of FIG. 1) there are provided the two belt conveying units 17, which can be disposed at adjustble mutual distance for their engagement with the sides of the variable width cartons. As it can be seen from FIGS. 1 and 2, each of the two conveying units 17 comprises a conveying belt 18 stretched between a pair of end pulleys 19 and 20, the first one of which is driving and the second is idle, and also engaged in intermediate position with a guiding and transversal retaining pad in antifriction material, indicated with 21 in FIG. 1. The whole is completed by a support structure formed by a lower plate 22 (FIG. 2) and by an upper cover 23, which closes also the outer side of the belt, leaving uncovered only the one turned towards the center of the support base 3.

As it can be seen from FIG. 1, each of the two driving pulleys 19 is fixed to a vertical shaft 24, which is the outlet shaft of a transmission conical group 25 slidingly mounted, and connected for the rotation, on a polygonal-section horizontal shaft 26, which transversally extends beneath the support base 3 at the outlet ends of the two conveying units 17 and is coupled to a suitable motor (not shown) by a belt or chain transmission 28. The vertical shaft 24 also functions as rotation pin for the support structure of the respective conveying unit 17.

As it can be seen from FIGS. 1 and 2, each of the two idle pulleys 20 is on the contrary rotatably mounted on a respective fixed vertical pin (not shown), which is rigidly fixed to the lower plate 22 and consequently, in general, to the protection structure of the respective conveying unit 17. To the plate 22 is also fixed a box-like support 37, which is in its turn fixed to a short cylindrical sleeve 38 slidingly mounted on a cylindrical guide 39, which transversally extends beneath the rollers 3, from a longer side to the other of the frame 51, at the inlet ends of the conveying units 17. Beneath the guide bar 39, substantially in the same vertical plane, there is rotatably disposed a threaded shaft 40, whose rotation through the crank 41 allows adjustment of the distance between the two conveying units 17, by fitting it to the different sizes of the cartons to be sealed. More precisely, as shown in FIG. 2, the threaded shaft is provided with two successive portions with opposite threads, with each of which there is engaged a nut screw 42, against which a spring 45 reacts. On the opposite part, the spring 45 reacts against a sliding bushing 46 fixed to the box-like support 37 to elastically stress this latter, and consequently the respective conveying unit 17, towards a position of minimum distance from the other conveying unit, once a prefixed adjustment has been obtained through the crank 41 and the shaft 40.

The working of the machine illustrated in the drawings is generally that of all the machines of the same kind, that is the cartons 4 sequentially inserted on the support base 3 in the direction of the arrow A are laterally engaged by the belts 18 of the conveying units 17 (adjusted at suitable distance) and caused to pass through the sealing area defined by the lower taping group 6 and by the upper taping group 9 (adjusted at suitable height), from which they receive the due sealing tapes.

The importance of the assembly is the way in which the vertical components of the machine, that is the legs 52 and the columns 7, can be removed, and then reattached, in order to reduce the overall size during transport.

As it can be seen from FIG. 9, the legs 52 can be easily separated from the frame 51 through axial sliding after having released the clamping action of the brackets 53, that is after having released the nut-bolt groups 54, 55.

As regards the columns 7, and obviously the associated crossbar 8 with the upper taping group 9, one firstly proceeds with the removal of the group 9 (as well as of the lower taping group 6) and then through the crank 16 (after having released the blocking bushing 71) one rotates the shaft 15 so as to lower the crossbar 8 until it rests on the hexagonal nut 66 (FIG. 10). The rotation of the shaft 15 is then raised to cause the disengagement of the same shaft from the threaded bush 14, which then can freely fall until it rests on an inner flap 74 of the lower piece 57 of the column 7 (FIG. 10). After having removed the blocking bolts 62 (FIG. 3), the two pieces 56 and 58 of every column, together with the threaded shaft 15 with crank 16, can then be separated from the underneath pieces 57 (FIG. 10) and then separated from each other. At that point the crossbar 8 can be removed by withdrawing the guide arm 10 from the respective column piece 57 and finally, once removed the blocking bolts 61 (FIG. 3), also the lower pieces 57 can be separated from the respective support brackets 64. To the frame 51 with relative rollers 2 and conveying units 17 thus remain attached only short brackets 64, which practically do not constitute cause of bulk in addition to that already caused by the conveying units 17. The overall size of the machine is thus reduced with respect to that of the assembled machine, which can be seen from FIGS. 2 and 3.

Figure 11:
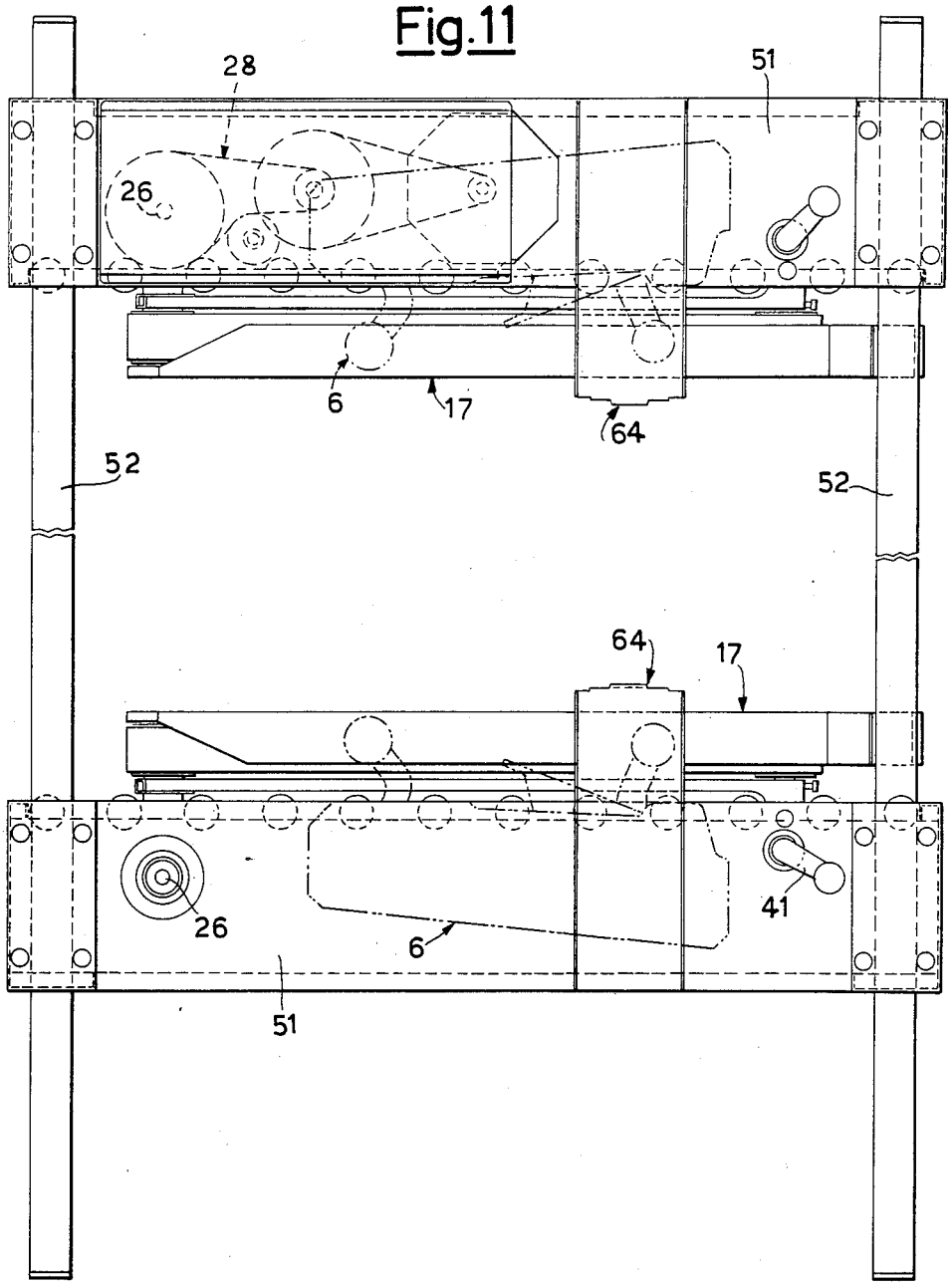
FIGS. 11 and 12 show, respectively in longitudinal and frontal view, the doubled condition of the machine, with two frames without columns superimposed and overturned with respect to one another and long common support legs of the two frames.
Figure 12:
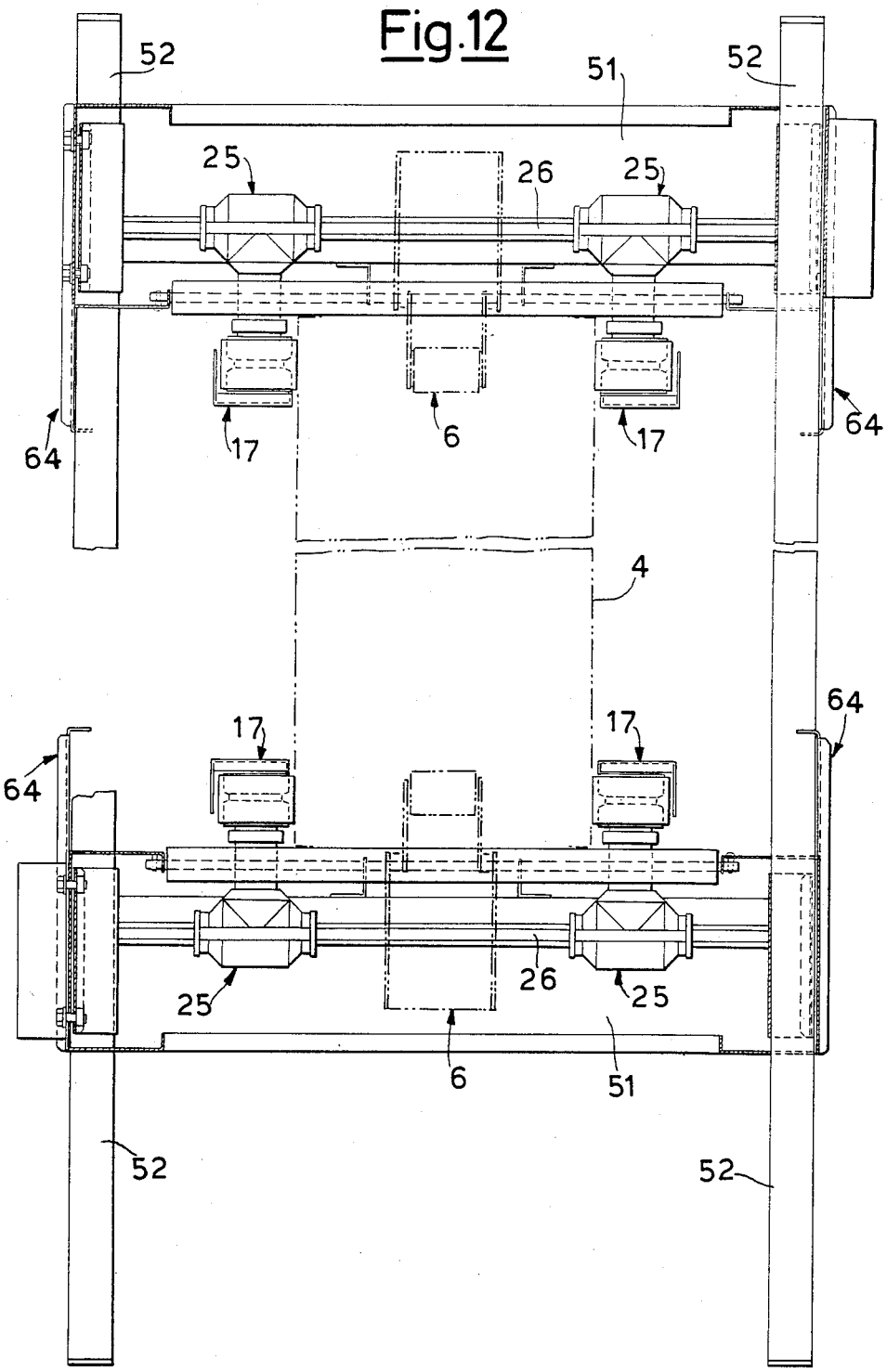

As previously pointed out, it is particularly interesting to note that the described features of removability of the vertical components of the machine make possible the "doubling" of the same machine for obtaining a machine able to seal particularly tall cartons. For such object, once disassembled two machines as explained above, it is sufficient to place the two frames 51 (both with conveying units 17 and lower taping group 6) the one on the other in overturned position and to fix the height by means of four common long legs 52 which pass through both frames and are clamped to them at the desired height, as evidenced in FIGS. 11 and 12. It is thus obtained a "doubled" machine, in which the carton is guided at the upper and lower portions, by the two pairs of conveying units 17 and is sealed on the top and on the bottom by the two taping groups 6. It is above all to be noted the importance of the double conveying engagement, which avoids the creation of carton turn-over or deformation moments and allows, as a result, the sure application of the upper tape in correct position.

I claim:

1. Taping machine, comprising a carton support base, a pair of carton conveying units, a lower taping means and an upper taping means, said support base comprising a frame provided with vertical legs which supports a plurality of idle transversal rollers, said conveying units and said lower taping means, two vertical columns extending upwardly from the frame suitable for supporting and guiding a support crossbar for the upper taping means, characterized in that said legs are coupled to the frame in passing-through way and releasably clamped thereto in adjustable position and said columns are releasably fixed to support brackets of limited vertical extension fixed to the frame.

2. Taping machine according to claim 1, characterized in that said legs are locked against the frame by C-shaped brackets releasably fixed to the same frame.

3. Taping machine according to claim 1, characterized in that each of said columns is formed by at least two pieces situated, an upper member as a vertical extension of a lower member, of which the lower member is releasably fixed to said support bracket and the upper member is releasably fixed to the lower member to extend its height up to a desired level.

4. Taping machine according to claim 3, characterized in that each of said columns comprises an intermediate member for surrounding said lower member and said upper member in a connection zone of the members, said intermediate member being releasably fixed to said support bracket.

5. A taping machine for cartons comprising a carton supported base, at least one carton conveying unit, an upper and lower taping means, said support base comprising a frame supporting a plurality of idle rollers, the conveying unit and said lower taping means, the frame further having two vertically extending columns for supporting and guiding a support crossbar for the upper taping means, said columns comprising an upper and lower member, the lower member being releasably connected to the frame and the upper member being releasably connected to the lower member, said upper and lower members being movable with respect to each other whereby the height of the support crossbar is adjustable from the support base, the upper and lower members being arranged such that the upper member and the crossbar are removable from the lower member and such that a second equivalent taping machine can be positioned in an inverted manner above a first taping machine with the lower members of cooperating columns being connectable whereby a carton may be sealed along its top and bottom.

6. A taping machine for sealing cartons comprising a carton support base, at least one carton conveying unit, an upper and lower taping means, said support base comprising a frame supporting a plurality of idle rollers, the conveying unit and said lower taping means, the frame further having two vertically extending columns for supporting and guiding a support crossbar for the upper taping means, a plurality of removable supporting legs for the frame extending through openings in the frame capable of providing height adjustment of the frame, the legs being releasably fixed to support brackets on the frame.

* * * * *